US008104848B2

(12) United States Patent
Yoon

(10) Patent No.: US 8,104,848 B2
(45) Date of Patent: Jan. 31, 2012

(54) DRYER HAVING DOOR OPENING AND CLOSING APPARATUS

(75) Inventor: Hyoung Tae Yoon, Gyeyang-gu (KR)

(73) Assignee: Daewoo Electronics Corporation, Seoul (KR)

( * ) Notice: Subject to any disclaimer, the term of this patent is extended or adjusted under 35 U.S.C. 154(b) by 535 days.

(21) Appl. No.: 12/343,524

(22) Filed: Dec. 24, 2008

(65) Prior Publication Data

US 2009/0167126 A1 Jul. 2, 2009

(51) Int. Cl.
*E05C 7/06* (2006.01)

(52) U.S. Cl. ..... 312/222; 312/228; 292/8; 292/10; 292/17; 292/80; 34/603

(58) Field of Classification Search ..... 403/252–254, 403/326, 327, 329; 292/8, 10, 13, 17, 80, 292/81, 91, DIG. 69; 312/222, 228; 68/12.26, 68/196; 34/595, 603
See application file for complete search history.

(56) References Cited

U.S. PATENT DOCUMENTS

| | | | | | |
|---|---|---|---|---|---|
| 389,605 | A * | 9/1888 | Shaw | 292/17 |
| 1,349,569 | A * | 8/1920 | Hart | 24/676 |
| 1,448,058 | A * | 3/1923 | Eis et al. | 200/541 |
| 2,526,791 | A * | 10/1950 | Wroblewski | 403/326 |
| 2,688,173 | A * | 9/1954 | Van Peet | 24/704.1 |
| 2,946,612 | A * | 7/1960 | Ahlgren | 292/17 |
| 3,466,075 | A * | 9/1969 | Wurster et al. | 292/19 |
| 3,780,904 | A * | 12/1973 | Stanford | 220/316 |
| 4,250,599 | A * | 2/1981 | Nagashima et al. | 24/326 |
| 2005/0134157 | A1* | 6/2005 | Hwang et al. | 312/265.6 |
| 2005/0225094 | A1* | 10/2005 | Lewis et al. | 292/19 |

* cited by examiner

*Primary Examiner* — James O. Hansen
*Assistant Examiner* — Matthew Ing
(74) *Attorney, Agent, or Firm* — Occhiuti Rohlicek & Tsao LLP

(57) ABSTRACT

A dryer having a door opening and closing apparatus are disclosed. The door opening and closing apparatus includes a cabinet provided with an opening part, a door installed to the cabinet to open and close the opening part, a hook provided to the door, a fixing part provided to the cabinet, a plate spring provided to the fixing part to allow the hook to be inserted therein and a projection part provided to the fixing part to allow the plate spring to be pivoted.

6 Claims, 5 Drawing Sheets

DRYER HAVING DOOR OPENING AND CLOSING APPARATUS

CROSS-REFERENCE TO RELATED APPLICATIONS

The present application claims priority to Korean patent application number 10-2007-0139532, filed on Dec. 27, 2007, which is incorporated by reference in its entirety.

BACKGROUND OF THE INVENTION

The present invention relates to a dryer having a door opening and closing apparatus which has a simple structure and allows accurate opening and closing operation of a door.

FIG. 1 is a schematic diagram showing a flow path of a conventional dryer and FIG. 2 is a partially broken perspective view of the conventional dryer.

Referring to FIGS. 1 and 2, the conventional dryer includes a case 2 which forms an external appearance of the dryer and provided with an opening formed in front thereof and through which laundries to be dried are put into the dryer, a drum 12 which is rotatably mounted inside the case 2 to accommodate the laundries to be dried and has opened front and rear portions for allowing air to pass therethrough, a heater 18 which is disposed inside the case 2 to heat the air sucked into the case 2, an intake duct 20 which guides the heated air passed through the heater 18 to the rear of the drum 12, an exhaust unit 22 which exhausts the air polluted by drying the laundries to the outside of the case 2, a blower fan (not shown) which is installed in the exhaust unit 22, and a motor (not shown) and a belt 40 which drive the drum 12 and the blow fan to be rotated. Further, a lifter 11 is mounted on an inner peripheral surface of the drum 12 to lift up and drop the laundries to be dried.

The exhaust unit 22 includes a lint duct 25 which receives the air from the drum 12 to filter foreign substances from the air by a filter 24 mounted therein, a fan housing 26 which communicates with the lint duct 25 and houses the blower fan and an exhaust duct 27 which communicates with the fan housing 26 at one end thereof and extends to the outside of the case 2 at the other end.

Operation of the conventional dryer having the above described structure is will be described. First, by operating the dryer after putting the laundries to be dried into the drum 12 and closing a door (not shown), the motor is driven to rotate the drum 12 and the blower fan and the heater 18 is operated together.

At this time, the laundries to be dried in the drum 12 are lifted up and dropped by the lifter 11 with the rotation of the drum 12. External air is sucked in the heater 18, heated to air with high temperature and low humidity and then supplied to the inside of the drum 12 through the intake duct 20.

The air with high temperature and low humidity supplied to the inside of the drum 12 is brought into direct contact with the laundries to dry the laundries and changed to air with low temperature and high humidity. While drying the laundries, the air is moved toward the front of the drum 12 and then discharged to the outside of the dryer through the exhaust unit 22.

In order to prevent the inside of the drum 12 is opened during the aforementioned operation, an opening and closing apparatus is installed between the door and the case 2.

Since the conventional door opening and closing apparatus has complex structure and requires a plurality of parts, there is a problem that it is difficult to reduce time and cost taken to manufacture the dryer. Therefore, it is required to improve the door opening and closing apparatus.

SUMMARY OF THE INVENTION

Embodiments of the present invention are directed to a dryer having a door opening and closing apparatus which has a simple structure and reduced number of parts.

Also, embodiments of the present invention are directed to a dryer having door opening and closing apparatus which is able to prevent the part from being deformed or broken by a biased load.

In one embodiment, a dryer having a door opening and closing apparatus which includes a cabinet provided with an opening part; a door installed to the cabinet to open and close the opening part; a hook provided to the door; a fixing part provided to the cabinet; a plate spring provided to the fixing part to allow the hook to be inserted therein; and a projection part provided to the fixing part to allow the plate spring to be pivoted.

Preferably, the fixing part includes a fixing panel having a hole part through which the hook is inserted or drawn out; and a cover coupled to the fixing panel and having a seating part in which the plate spring is seated.

More preferably, the projection part is provided in the seating part in a left-right direction.

More preferably, the fixing panel includes a guide part in which the plate spring is inserted; and a flange part formed at the guide part and projected to oppose to the plate spring.

More preferably, the flange part is formed in such a way that the middle portion of the guide part is formed so as to be inwardly concave.

More preferably, the plate spring includes a first bended part caught in one side of the hook; a second bended part caught in the other side of the hook; a connection part connecting the first bended part and the second bended part; and projection parts projected from the connection part in a lateral direction to be interposed between the flange part and the seating part.

More preferably, the plate spring is formed in a '⊏' shape.

More preferably, in the plate spring, the connection part and the projection parts are formed by cutting a metal material having a panel shape and the first bended part and the second bended part are formed by bending.

More preferably, the projection part is provided so as to be in contact with the middle of the connection part.

More preferably, the projection part is provided in a left-right direction on the seating part.

According to the present invention, it is possible to perform an opening and closing operation of the door by the plate spring manufactured by a single process. Therefore, it is possible to reduce the time and cost taken to manufacture the door opening and closing apparatus and thus lower the unit price of the product.

Also, according to the present invention, when the hook is inserted in the plate spring, the hook is inserted through the middle of the plate spring while the plate spring is moved by a predetermined amount. Therefore, it is possible to prevent some portion of the plate spring from being subject to a biased load and thus prevent deformation and breakdown of the plate spring, thereby lengthening the life time of the product.

DESCRIPTION OF SPECIFIC EMBODIMENTS

Hereinafter, an exemplary embodiment of the present invention will be described with reference to accompanying drawings.

For convenience of description, a drum type dryer will be described by way of example.

It should be noted that the drawings are not to precise scale and may be exaggerated in thickness of lines or size of components for the purpose of convenience and clarity only.

Furthermore, terms used herein are defined in consideration of functions in the present invention and can be changed according to the custom or intention of users or operators.

Thus, definition of such terms should be determined according to overall disclosures set forth herein.

Figure 1:
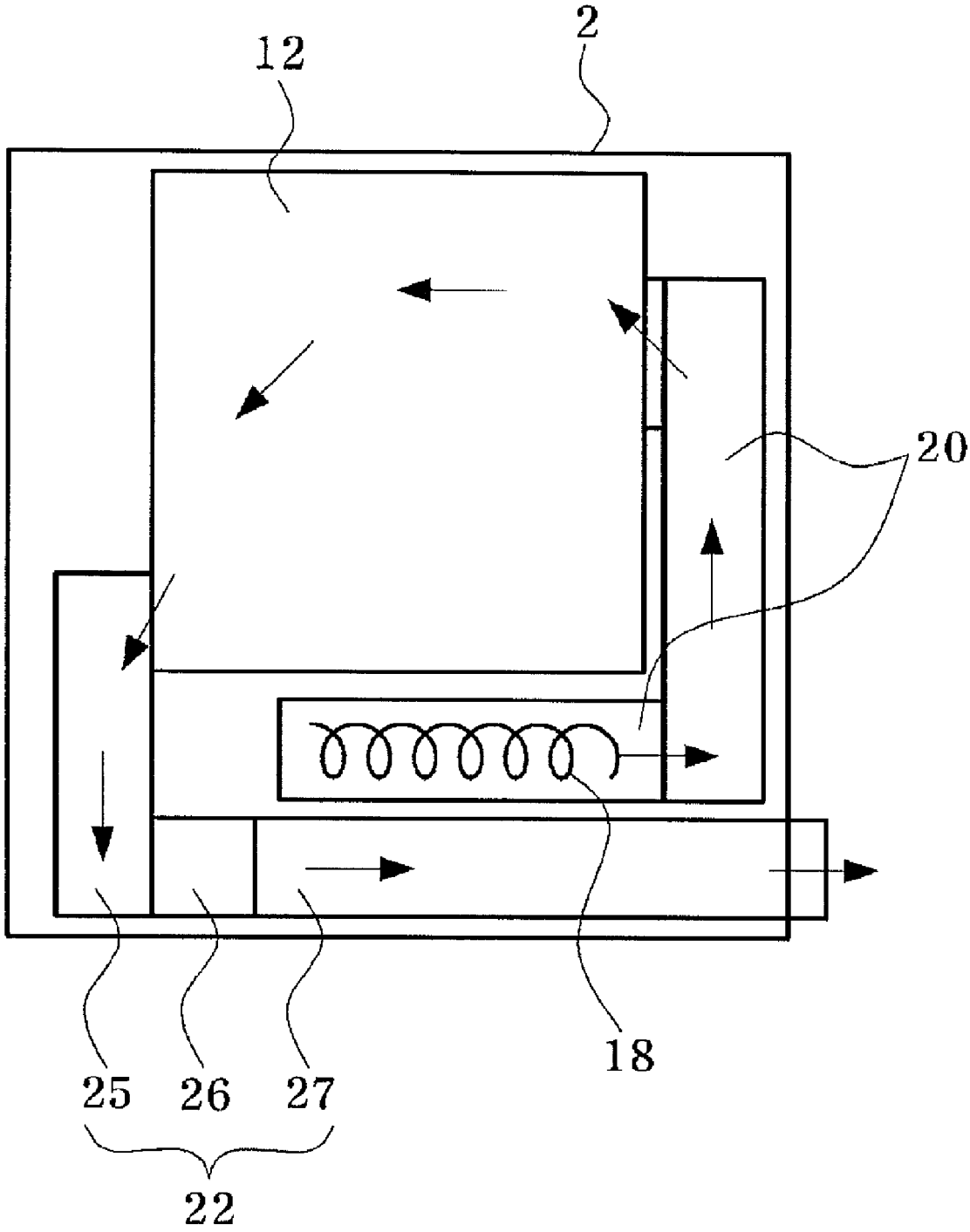
FIG. 1 Prior Art
FIG. 1 is a schematic diagram showing a flow path of a conventional dryer.
Figure 2:
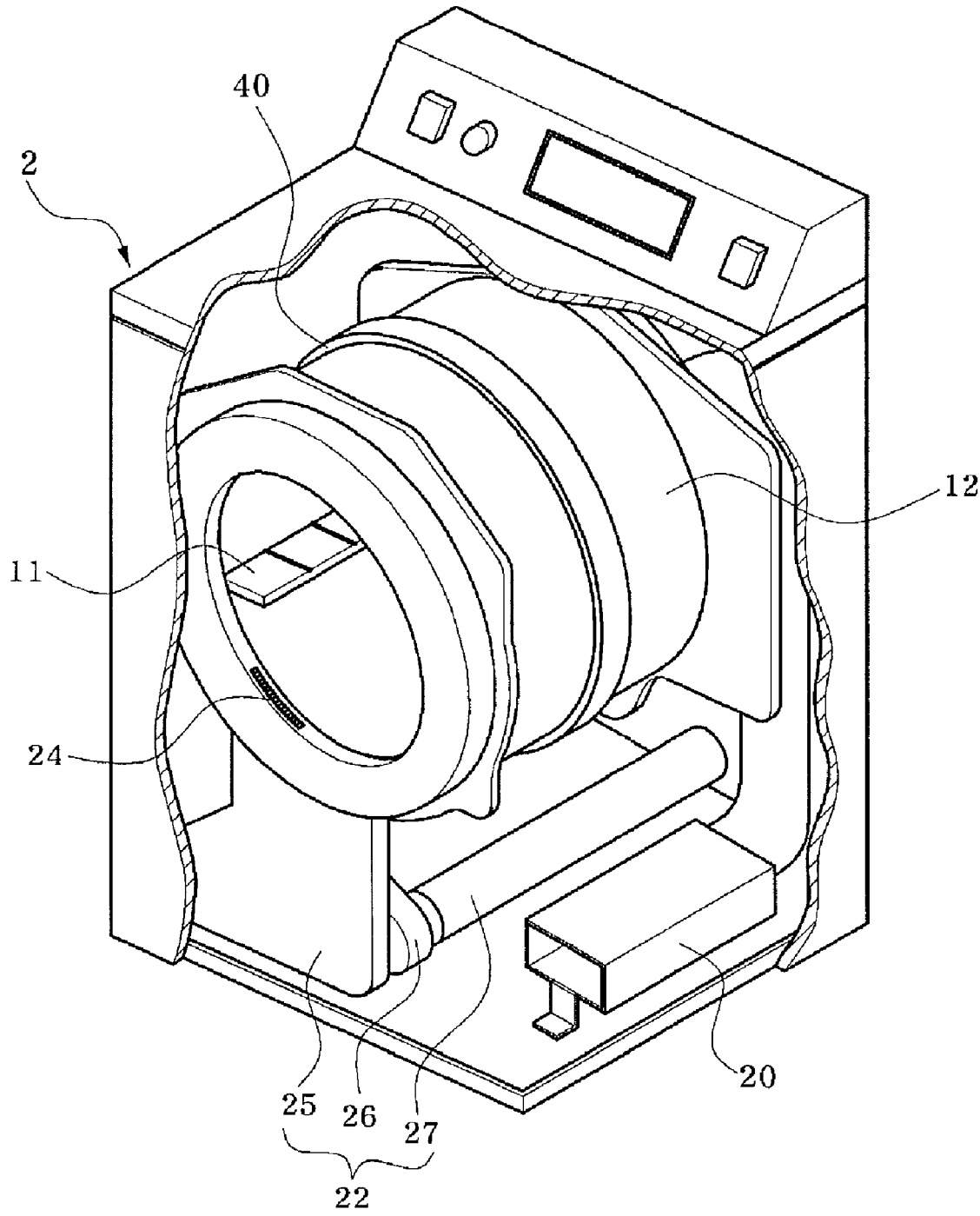
FIG. 2 Prior Art
FIG. 2 is a partially broken perspective view of the conventional dryer.
Figure 3:
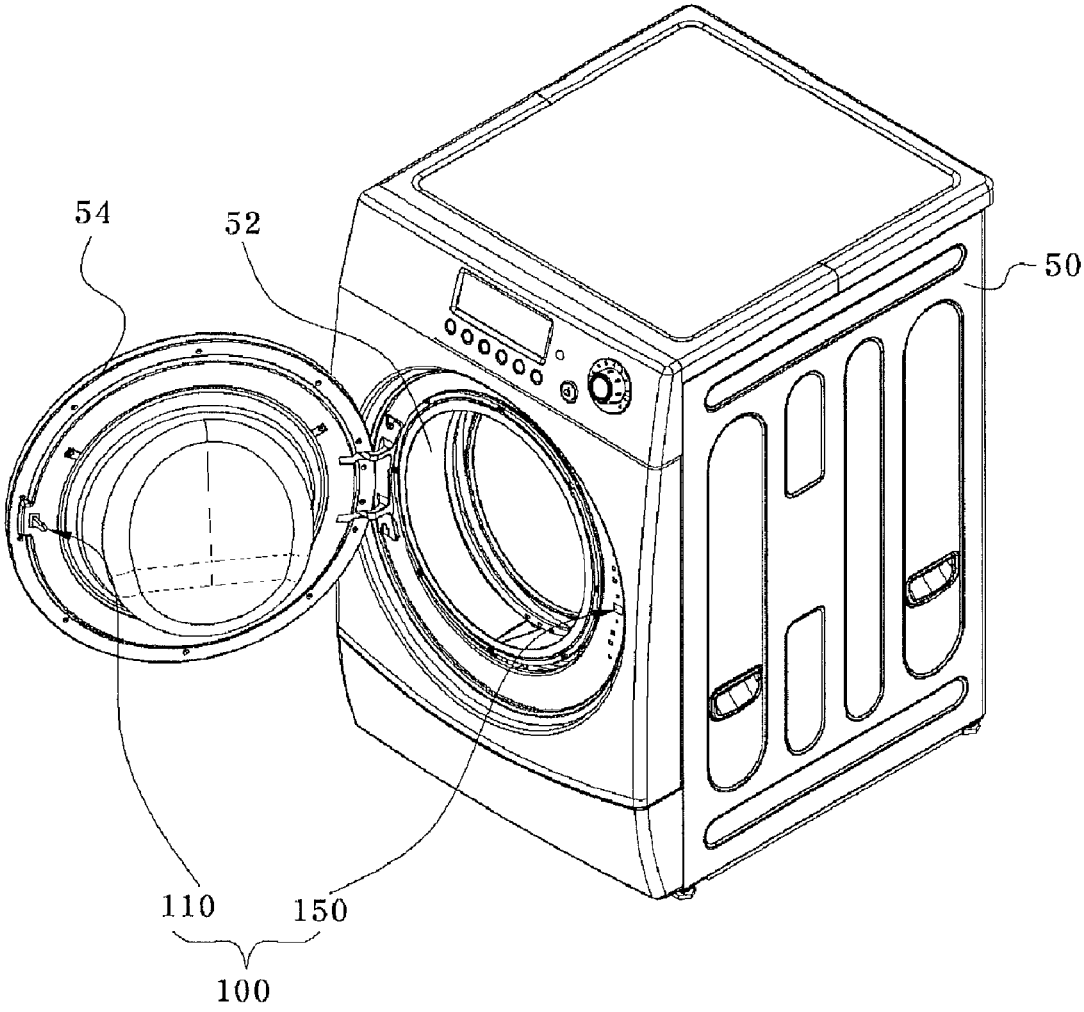
FIG. 3 is a perspective view illustrating a dryer having door opening and closing apparatus in accordance with an embodiment of the present invention.
Figure 4:
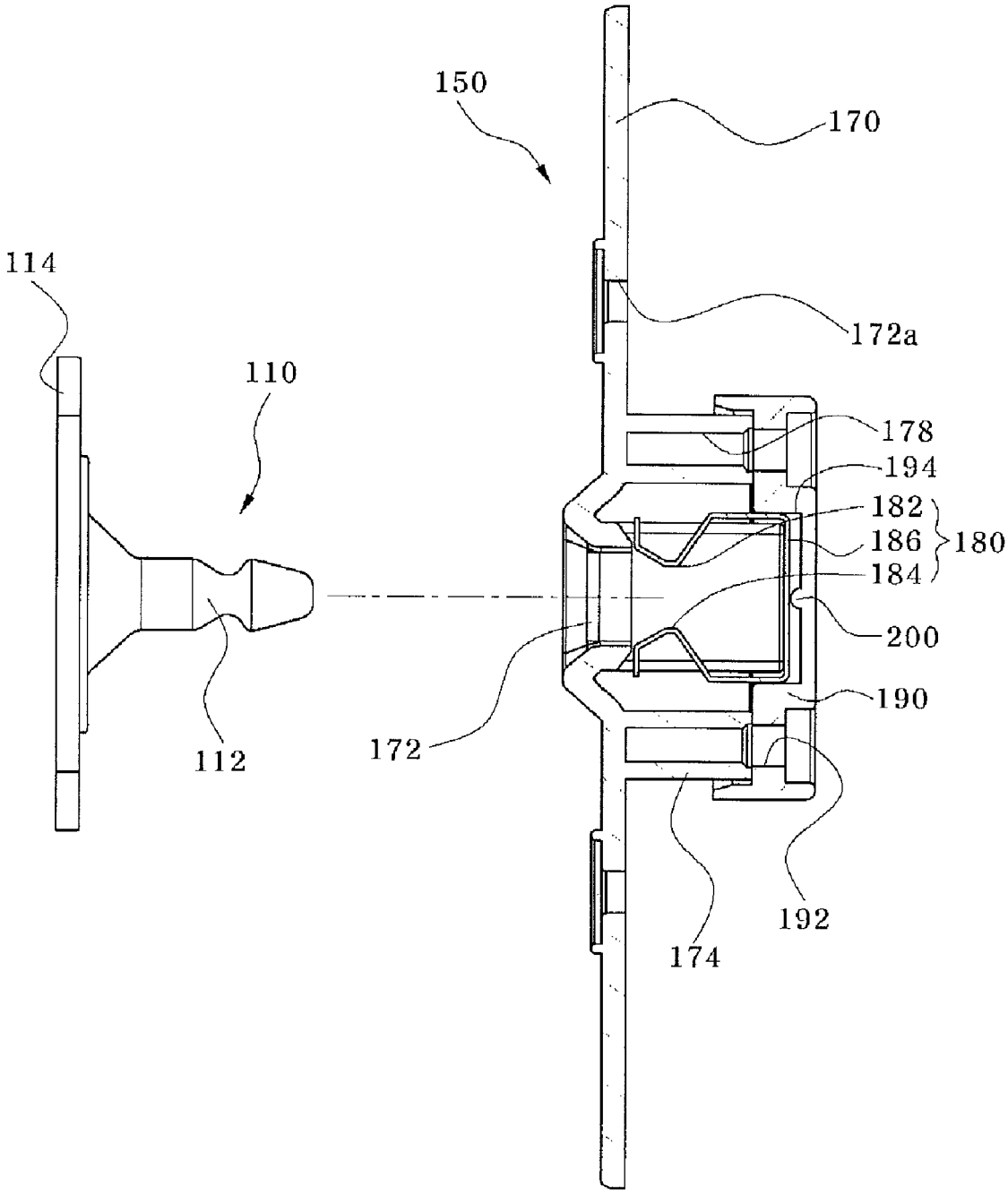
FIG. 4 is an exploded cross-sectional view illustrating the door opening and closing apparatus in accordance with an embodiment of the present invention.

FIG. 3 is a perspective view illustrating a dryer having door opening and closing apparatus in accordance with an embodiment of the present invention; FIG. 4 is an exploded cross-sectional view illustrating the door opening and closing apparatus in accordance with an embodiment of the present invention; and FIG. 5 is an exploded perspective view illustrating a fixing part of the door opening and closing apparatus in accordance with an embodiment of the present invention.

Figure 5:
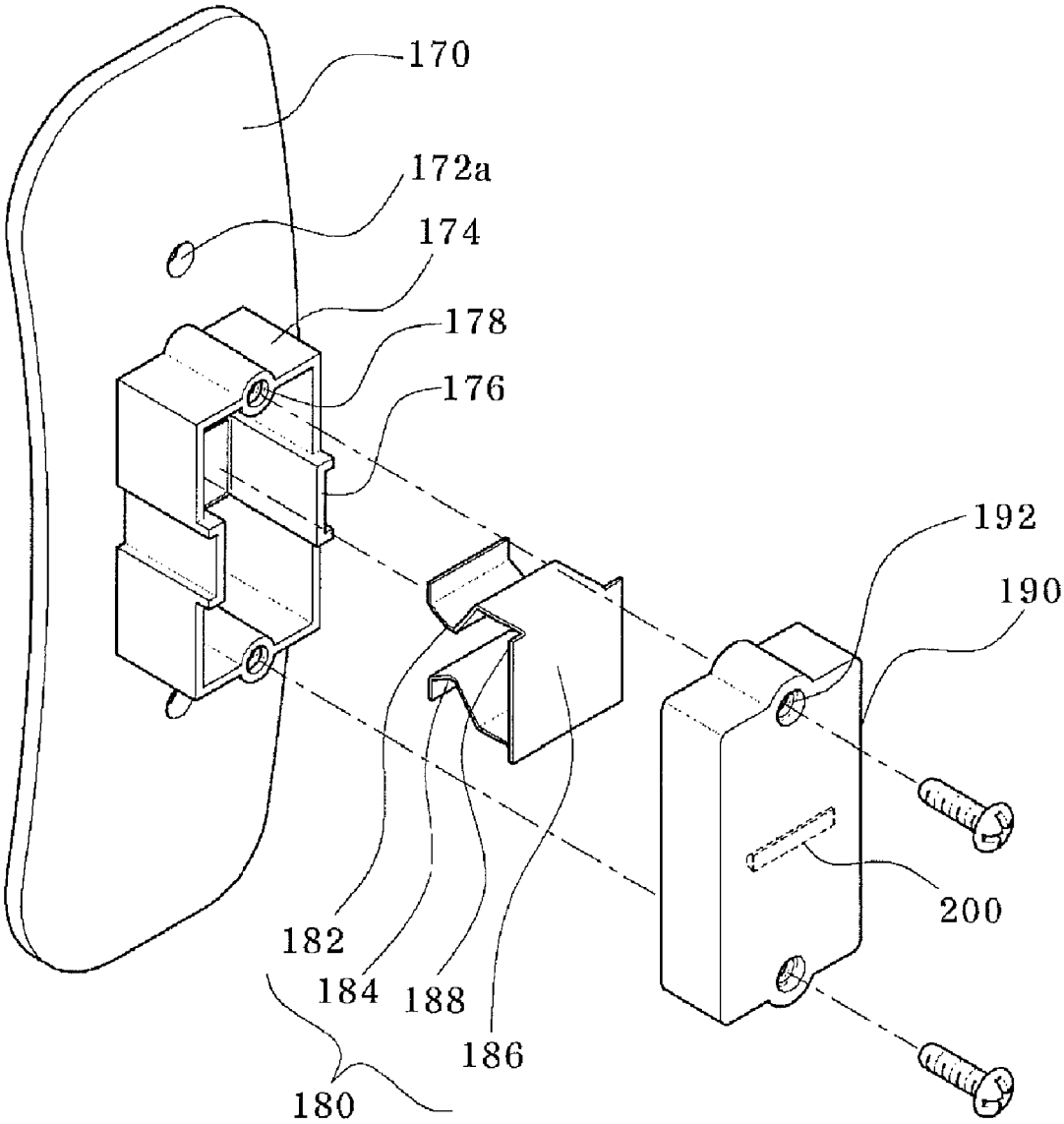
FIG. 5 is an exploded perspective view illustrating a fixing part of the door opening and closing apparatus in accordance with an embodiment of the present invention.

Referring to FIGS. 3 through 5, a dryer provided with a door opening and closing apparatus 100 includes a cabinet 50 to which a door 54 is openably and closably installed, a hook 110 installed on the door 54, a fixing part 150 which is installed in an opening part 52 of the cabinet 50 corresponding to the door 54 and allows the hook 110 to be inserted therein, a plate spring 180 loosely provided in the fixing part 150 and allows the hook 110 to be inserted therein and a projection part 200 which is provided in the fixing part 150 and allows the plate spring 180 to be pivoted.

When closing the door 54, the hook 110 is inserted in the fixing part 150 to be coupled to the plate spring 180. At this time, the hook 110 is inserted between the first bended part 182 and the second bended part 184 which will be described later to complete the coupling.

The plate spring 180 is pivoted in an up-down direction around the projection part 200 to allow the hook 110 to be inserted through the middle between the first bended part 182 and the second bended part 184.

With this operation, it is possible to prevent that the hook 110 inserted in the plate spring 180 concentratedly presses the first bended part 182 or the second bended part 184 and thus prevent that the first bended part 182 or the second bended part 184 are deformed or broken by the biased load.

The projection part 200 is formed long in a left-right direction on the seating part 194 of the fixing part 150 which will be described later. The plate spring 180 is therefore rotated not in the left-right direction but in an up-down direction.

The hook 110 is formed integrally with the coupling panel 114 which is mounted on the door 54 and is provided with an inwardly concave coupling part 112 at an end part thereof which is inserted in the plate spring 180.

The fixing part 150 includes a fixing panel 170 provided with a hole part 172 through which the hook 110 is inserted and a cover 190 formed with the seating part 194, in which the plate spring 180 is installed, and coupled to the fixing panel 170. The fixing panel 170 is coupled to a rim of the opening part 52 through a mounting hole parts 172*a*.

The door opening and closing apparatus is installed by inserting a rear end of the plate spring 180 into the seating part 194, coupling the cover 190 to the fixing panel 170 and then mounting the resultant assembly to the rim of the opening part 52.

The fixing panel 170 and the cover 190 are coupled by inserting fastening members in through hole parts 192 formed in the cover 190 to fasten the fastening members to fastening hole parts 178 formed in the fixing panel 170.

The fixing panel 170 includes a guide part 174 in which a front end of the plate spring 180 is inserted and a flange part 176 which is provided in the guide part 174 to press the plate spring 180 toward the cover 190.

The guide part 174 is a rectangular member extended from the hole part 172 to the rearward. When the plate spring 180 is inserted in the guide part 174, the opened part of the plate spring 180 is disposed correspondingly to the hole part 172 and the hook 110 inserted through the hole part 172 is thus coupled to the plate spring 180.

The flange part 176 is formed in such a way that the middle portion of the guide part 174 is formed so as to be inwardly concave, and thus prevents the left-right directional movement of the plate spring 180. Also, the flange part 176 is formed so as to be projected to the rearward.

The plate spring 180 includes the first bended part 182 which is caught in one side of the hook 110, a second bended part 184 which is caught in the other side of the hook 110, a connection part 186 which connects the first bended part 182 and the second bended part 184 and projection parts 188 which are projected from the connection part 186 in a lateral direction to be interposed between the flange part 176 and the seating part 194.

The plate spring 180 has such a shape that the first bended part 182, the second bended part 184 and the connection part 186 form generally a '⊏' shape when viewed from the side thereof, and the first bended part 182 and the second bended part 184 which are inwardly concave are formed at the end portion of the opened part.

In a case of the seating part 194, since an inner wall of the cover 190 is formed to be concaved in a rectangular shape, the flange part 176 alone is inserted in the inside of the seating part 194 to be closer to the projection parts 188 of the plate spring 180 when coupling the cover 190 to the guide part 174.

In a case of the plate spring 180, the connection part 186 and the projection parts 188 are formed by cutting a metal material having a panel shape and the first bended part 182 and the second bended part 184 are formed by bending.

Therefore, since a single part manufactured by a single process performs the opening and closing operation, it is possible to reduce time and cost taken to manufacture the opening and closing apparatus 100.

Hereinafter, installation and operation of the door opening and closing apparatus in accordance with an embodiment of the present invention will be described.

First, the connection part 186 of the plate spring 180 is inserted in the seating part 194 of the cover 190, the cover 190 is seated in an upper end of the guide part 174 of the fixing panel 170, and after that, the fastening member is inserted in the through hole part 192 and the fastening hole part 178 to fasten them, thereby completing assembly of the fixing part 150.

At this time, the projection parts 188 of the plate spring 180 is interposed between the flange part 176 and the seating part 194, and the plate spring 180 is thus prevented from being leaved therefrom.

Since the space between the flange part 176 and the seating part 194 is formed to be greater by a predetermined amount than the thickness of the projection parts 188, it is possible to prevent the leave of the plate spring 180 and at the same allow the movement of the plate spring 180 by a predetermined amount.

After that, the fixing panel 170 is disposed on the rim of the opening part 52 of the cabinet 50 and a fastening member is coupled through the mounting hole part 172*a*, thereby completing the installation of the fixing part 150. Next, the coupling panel 114 is mounted on the door 54, thereby completing the door opening and closing apparatus 100.

When closing the door 54 to which the installation of the door opening and closing apparatus is completed as described above, the hook 110 is inserted in the hole part 172 and then mounted to the plate spring 180.

At this time, the plate spring 180 is pivotable by a predetermined amount around the projection part 200 in the up-down direction. Therefore, even though the hook 110 is not inserted through the middle between the first bended part 182 and the second bended part 184 but inserted biasedly to the first bended part 182 or the second bended part 184 by drooping of the door and the like, the plate spring 180 is pivoted upwardly or downwardly in the direction of the insertion of the hook 110. Consequently, the hook 110 comes to be inserted through the middle between the first bended part 182 and the second bended part 184.

While the hook 110 is inserted in the inside of the plate spring 180, the first bended part 182 and the second bended part 184 of the plate spring 180 are deformed in an outward direction. When the insertion of the hook 110 is completed, the deformed plate spring 180 is restored to the original shape to seat the first bended part 182 and the second bended part 184 in the coupling part 112 of the hook 110, thereby firmly coupling the hook 110 and the fixing part 150.

When opening the door 54, the door 54 is pulled from the opening part 52 and the hook 110 is drawn out to the outside of the plate spring 180 and the hole part 172 while the plate spring 180 is deformed as described above, thereby completing the opening of the door 50.

Although the present invention has been described with reference to the embodiments and the accompanying drawings, it will be apparent to those skilled in the art that the embodiments are given by way of illustration, and that various modifications and equivalent embodiments can be made without departing from the spirit and scope of the present invention.

In addition, although the present invention has been described with reference to the dryer having the door opening and closing apparatus as specifically described herein, it should be noted that the dryer having the door opening and closing apparatus has been illustrated by way of example, and that the door opening and closing apparatus of the present invention may be applied to other product, particularly to a drum washer, without being limited to the dryer in its application.

Accordingly, the scope and spirit of the present invention should be limited only by the following claims.

What is claimed is:

1. A dryer having a door opening and closing apparatus, the door opening and closing apparatus comprising:

a cabinet provided with an opening part;

a door installed to the cabinet to open and close the opening part;

a hook provided to the door; a fixing part provided to the cabinet;

a plate spring provided to the fixing part to allow the hook to be inserted therein; and a projection part provided to the fixing part to allow the plate spring to be pivoted, wherein the fixing part includes:

a fixing panel having a hole part through which the hook is inserted or drawn out; and a cover coupled to the fixing panel and having a seating part in which the plate spring is seated, the fixing panel includes:

a guide part in which the plate spring is inserted; and a flange part formed at the guide part and projected to limit the motion of the plate spring, the flange part being formed in such a way that the middle portion of the guide part is formed so as to be inwardly concave, and the plate spring includes a first bended part configured to be caught in one side of the hook;

a second bended part configured to be caught in the other side of the hook;

a connection part connecting the first bended part and the second bended part; and protrusions projected from the connection part in a lateral direction so as to be interposed between the flange part and the seating part.

2. The dryer having a door opening and closing apparatus of claim 1, wherein the projection part is provided in the seating part in a left-right direction.

3. The dryer having a door opening and closing apparatus of claim 1, wherein the plate spring is formed in a 'c' shape.

4. The dryer having a door opening and closing apparatus of claim 1, wherein in the plate spring, the connection part and the protrusions are formed by cutting a metal material having a panel shape and the first bended part and the second bended part are formed by bending.

5. The dryer having a door opening and closing apparatus of claim 1, wherein the projection part is provided so as to be in contact with the middle of the connection part.

6. The dryer having a door opening and closing apparatus of claim 1, wherein the projection part is provided in a left-right direction on the seating part.

* * * * *